United States Patent [19]

Wilson

[11] 4,327,826

[45] May 4, 1982

[54] RECIPROCATING PUSHER CONVEYOR

[75] Inventor: Wilfred W. Wilson, Toronto, Canada

[73] Assignee: Ontario, Limited, Ontario, Canada

[21] Appl. No.: 90,606

[22] Filed: Nov. 2, 1979

Related U.S. Application Data

[62] Division of Ser. No. 848,479, Nov. 4, 1977, Pat. No. 4,173,107.

[51] Int. Cl.[3] ..... B65G 25/02

[52] U.S. Cl. ..... 198/740; 198/487

[58] Field of Search ..... 198/430, 487, 740, 488

[56] References Cited

U.S. PATENT DOCUMENTS 2,983,361 5/1961 Tibbals ..... 198/430

3,151,727 10/1964 Glaubke ..... 198/487

*Primary Examiner*—Joseph E. Valenza

*Attorney, Agent, or Firm*—Knobbe, Martens, Olson, Hubbard & Bear

[57] ABSTRACT

There is provided an apparatus for repeatedly unloading uncooked sausages from a support table by a reciprocating pusher. The pusher is lifted on its return by a spring attached to the pusher, which applies a varying upward force due to its cooperation with a stationary support element adjacent the free end of the spring.

4 Claims, 5 Drawing Figures

RECIPROCATING PUSHER CONVEYOR

This is a division, of application Ser. No. 848,479, filed Nov. 4, 1977 now U.S. Pat. No. 4,173,107.

RELATED APPLICATIONS

This application is a divisional application of U.S. Pat. No. 4,173,107, entitled "Collating and Packaging Machine". Said patent should be consulted for disclosure of the entire system for which the patent forms but one component.

BACKGROUND OF THE INVENTION

The meat-packing industry has been the scene of important advances in the area of automated loading and packaging of specially prepared meat items such as weiners, frankfurters, and so forth. These advances, however, have been limited to the area of cooked meat products, including cooked sausages, weiners and the like. No similar automation advances have been developed for the handling and packaging of uncooked sausages. As a result, it is the almost universal practice to hand-load the uncooked sausages into trays. The reason for this failure on the part of the industry to automate and thus render more efficient the handling and packaging of uncooked sausage, as compared to any similar but cooked item like a cooked sausage, cooked weiner, and so forth. Uncooked sausages are extremely flaccid, limp and "squishy", to such an extent that machine components like tongs or suction devices are not able to handle them consistently and with a failure rate near zero. It will be understood that it is quite essential for any automated machine to be capable of continuous operation with a virtually zero failure rate, since a single failure can cause the machine to be shut down, result in expensive "down time", and so forth.

To use a specific example, it takes five workers about one hour to load 1,000 pounds of uncooked sausage into trays ready for wrapping. This represents several thousand individual sausages. If an automated machine were to take the place of these five workers, and run continuously over an eight-hour shift without a single failure on a single sausage (i.e., without allowing a single sausage to become stuck in the machine, gum up the operation of the machine, and the like), the failure rate would have to be less than one sausage in better than ten-thousand sausages, this being less than 1/100th of 1%. Until now, due to the flaccidity of uncooked sausages, this kind of performance simply has not been achievable.

Accordingly, it is a primary aspect of this invention and of parent U.S. Pat. No. 4,173,107, to succeed, where prior attempts have failed, in providing an automated machine capable of packaging uncooked sausages into sausage trays and also capable of rejecting any sausages having a length either greater or smaller than a specific range suitable for the particular tray size, thus effecting weight control in the packed trays.

This invention provides a reciprocating mechanism for repeatedly pushing items stacked on a support surface, the mechanism comprising: a low friction support table; a pusher member; reciprocating power means for urging the pusher member alternatingly in a forward direction across the support surface and then in a rearward direction; means laterally of the pusher member defining at least one cam track having a lower track segment substantially parallel with the support surface, an upward segment at the forward end of the lower segment, a return segment above said lower segment, and a downward segment joining the return and lower segments at the rear; follower means on the pusher member for following said cam track; and spring means for gradually increasing upward force on the pusher member as the latter moves forwardly, the upward force at the forward end being strong enough to raise the pusher member up to the return leg, but being weak enough at the rearward end to allow the pusher member to return by its own weight to the lower leg.

In yet another aspect, this invention provides an apparatus for using pressurized gas such as air for handling soft, flaccid, easily deformable, uncooked sausages without unduly damaging them, comprising: a member positioned on one side and slightly above the support table, having a cavity with a plurality of holes oriented to create a directed curtain of air across the top of the table when the cavity is air pressurized. This pressurized air causes positive placement of the sausages on the support table without unacceptably deforming the sausages.

BRIEF DESCRIPTION OF THE DRAWINGS

One embodiment of this invention is illustrated in the accompanying drawings in which like numerals denote like parts throughout the several views, and in which.

DETAILED DESCRIPTION OF THE PREFERRED EMBODIMENT

Figure 1:
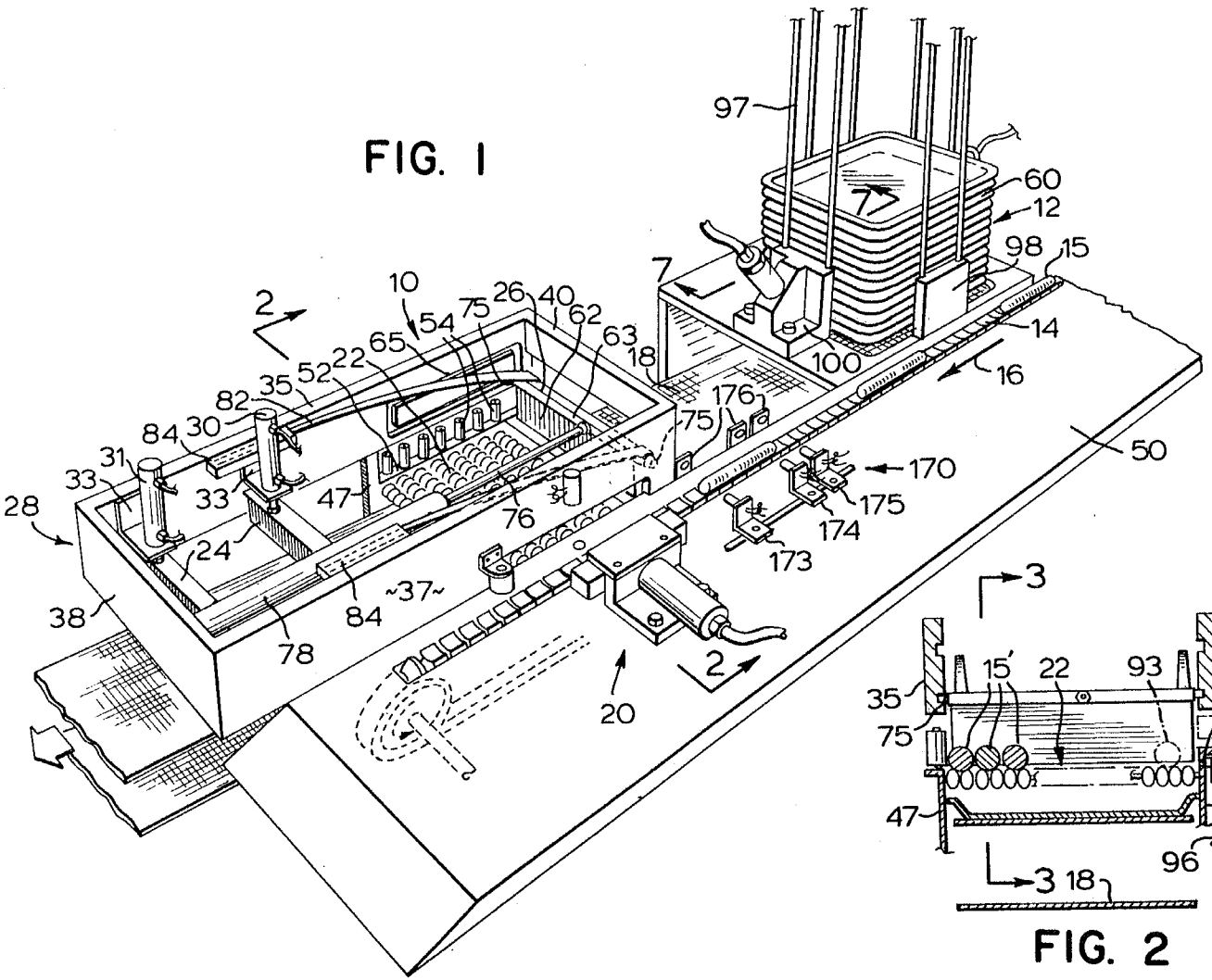
FIG. 1 is a general perspective view of an apparatus constructed in accordance with this invention.

Turning first to FIG. 1, the apparatus generally shown by the numeral 10 is seen to include the following basic components: a tray dispensing assembly 12, a first endless conveyor 14 for conveying sausages 15 or the like along a straight path in the forward direction as identified by the arrow 16, a second endless conveyor 18 laterally adjacent to the first endless conveyor 14 and passing beneath the tray dispensing assembly 12 so that it can transport trays sequentially in the forward direction identified by the arrow 16, a loader means 20 adjacent the first conveyor 14 on the side opposite from that of the second endless conveyor 18 (i.e., the nearer side as seen in FIG. 1), the loader means 20 being adapted to displace the sausages 15 laterally off the first conveyor 14 (which would be away from the viewer in FIG. 1), means defining a table surface 22 suspended over the second conveyor 18 forwardly of the dispensing assembly 12 and adapted to receive sausages which are displaced laterally by the loader means 20, stop bars 24 for arresting a tray on the second conveyor 18 in a desired position with respect to the table surface 22, and pusher means which is located generally above the table surface 22, and is adapted to push off the surface 22 and into a tray on the second endless conveyor 18 sausages which collect on the surface 22.

A rectangular frame 28 is provided to enclose and support the means defining the table surface 22, the pusher means 26 and the stop bars 24 with their associated operating devices. The construction and function of the various items within the rectangular frame 28 will now be described in greater detail.

Figure 3:
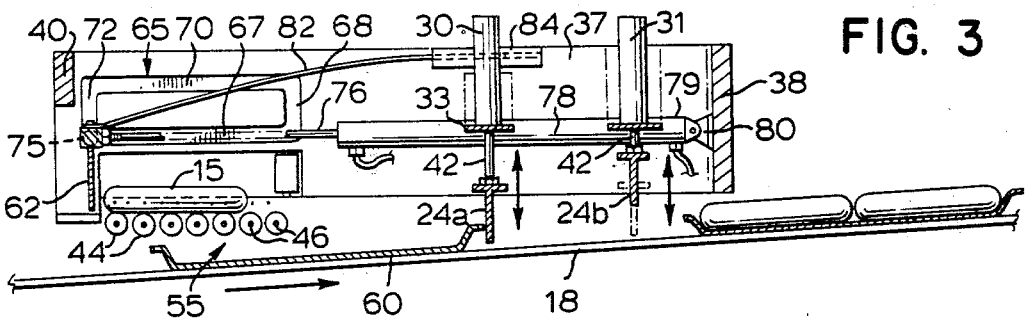
FIG. 3 is a vertical sectional view taken at the line 3—3 in FIG. 2, showing the apparatus at one stage of its operation.
Figure 4:
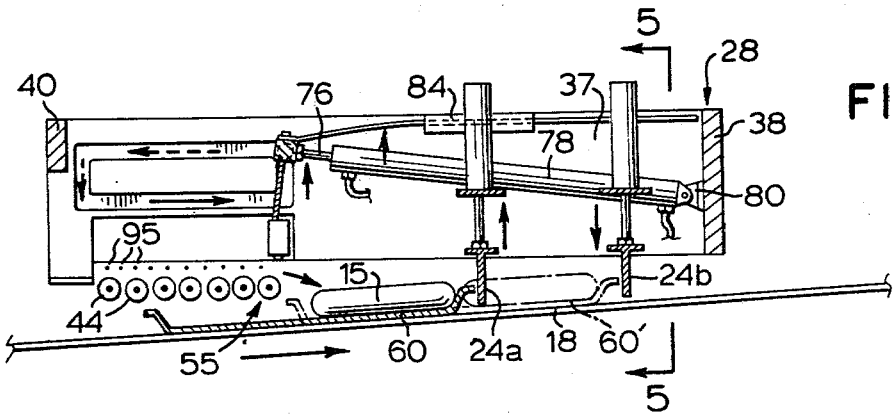
FIG. 4 is a view similar to that of FIG. 3, showing the apparatus at a subsequent stage in its operation.

Firstly, the rectangular frame 28 is suspended above and out of contact with the second endless conveyor 18 as can be seen in FIGS. 3 and 4. The endless conveyor 18 can be constituted by a single endless conveyor, or can be constituted by a plurality of sequential conveyors in the manner well known in the industry. The use of a plurality of conveyors is often resorted to when the angle defined by the conveying surface to the horizontal is intended to change over its length.

As best seen in FIGS. 1, 3, and 4, the stop bars 24 are controlled by two air-operated cylinders 30 and 31. The stop bars controlled by these cylinders are identified in FIGS. 3 and 4 as 24*a* and 24*b*, respectively. Each of the cylinders 30 and 31 is mounted on an angle bracket 33 secured to a side 35 of the rectangular frame 28. The opposite side of the frame is identified by the numeral 37, the forward end by the numeral 38 and the rearward end by the numeral 40.

The stop bars 24*a* and 24*b* are constituted, as can be seen in FIGS. 3 and 4, by extrusions of T-shaped cross section, which may be of aluminum or other like material. Each of the stop bars 24*a* and 24*b* is secured at the bottom end of the piston 42 of its respective air-operated cylinder 30,31.

The position of the table surface 22 with respect to the second endless conveyor 18 is best seen in FIGS. 3 and 4. The table surface 22 is not a single integral surface, but rather is defined by a plurality of rollers 44 strung on cross rods 46 which extend perpendicularly between the sides 35 and 37 of the rectangular frame 28, and thus perpendicular to what has been identified as the forward direction 16. The rollers 44 are freely rotatable, and the rollers on adjacent cross rods 46 do not touch. The rollers 44 are made of a low-friction material like nylon, so that there will be no tendency for the sausages 15 to stick to their surfaces. Thus, because the rollers 44 are free to rotate, there is little or no frictional resistance against movement of the sausages 15 in the forward direction with respect to the table surface defined by the rollers 44.

The cross rods 46 are secured at either end to portions of the main frame structure for the apparatus, which includes a vertical partition 47 below the side 35, and a further partition 49 extending downwardly from the top surface of a main horizontal mounting plate 50. This construction is particularly well illustrated in FIG. 2.

Partition 47 supports, along an upper edge 52 thereof, a plurality of rollers 54 of cylindrical configuration, mounted for free rotation about vertical axes. These rollers constitute a stop or abuttment means at the far or leftward side of the table surface 22, against which the first sausage to enter the table surface 22 can come to rest. The fact that the rollers 54 are freely rotatable means that the end sausage will not encounter any frictional drag when it is moved forwardly off the table surface 22 by the pusher means 26 which is shortly to be described.

Before describing the pusher means, it should be pointed out that the table surface 22 has a free forward edge 55 which is suspended above the second conveyor 18. The free forward edge is, in effect, defined by the furthest forward series of rollers 44, but the point being made is that there is no abuttment or other means which would prevent sausages from moving forwardly off the forward edge 55 of the table surface 22.

The pusher means 26 is located generally above the table surface 22, and is adapted to reciprocate in a direction parallel to the arrow 16.

As will be understood, the mechanism under discussion is adapted repeatedly, at timed intervals, to push a plurality of sausages stacked in side-by-side relationship on the table surface 22 in the forward direction 16, so that they pass beyond the free forward edge 55 and into a tray 60 which has been brought forwardly along the second conveyor 18 and which is held in stopped position by the stop bar 24*a* (FIG. 3). As can be seen in FIG. 3, the tray 60 is located such that its rearward half remains under the table surface, while its forward half projects forwardly of the forward edge 55 and is adapted to receive sausages displaced forwardly from the table surface 22.

The mechanism includes a pusher blade 62, which is rectangular in configuration and which extends downwardly from a horizontal support strut 63.

The side 35 of the rectangular frame 28 and the opposite side 37 are both configured to define a cam track 65 which has a lower leg 67, an upward leg 68 at the forward end of the lower leg 67, a return leg 70 above the lower leg 67, and a downward leg 72 joining the return and lower legs together at the rear. In effect, the four legs of the cam track define a rectangle, as is clearly seen in FIG. 3.

The support strut has, at either end, follower means adapted to follow the respective cam tracks in the sides 35 and 37. The follower means is constituted by two freely rotating follower wheels 75 at either end of the support strut 63.

At its mid-region the support strut 63 is firmly attached to the distal end of the piston 76 of an air cylinder 78. The other end of the cylinder 78 is pivotally attached to a bracket 80 which is affixed to the end 38 of the rectangular frame 28.

Attached to the top of the support strut at either end thereof are two spring elements in the form of resilient metal strap members 82. The strap members extend generally in the forward direction from their location of attachment to the top of the support strut 63, and each one passes centrally through an open-ended sleeve member 84, which in the embodiment shown is generally of rectangular configuration. The center opening of the sleeve member is also rectangular, with a smaller vertical dimension than the horizontal dimension. The resilient strap members 82 are also flattened in configuration, and can be received slidingly within the sleeve members 84.

At no time during the circuit of the follower wheels 75 around the cam track 65 do the strap members 82 become fully disengaged from the sleeve members 84. The resilience and configuration of the strap members 82 is such that as the air cylinder 78 contracts, pulling the support strut in the forward direction, the resilient strap members 82 begin to feed through the respective sleeve members 84.

It is important to note that the sleeve members 84 are oriented in such a way that the hypothetical center axis if extended passes above all portions of the cam tracks 65. The strap members 82 are such that, when unstressed, they seek a rectilinear or straight configuration. As can be best understood from FIG. 3, the fact that the sleeve members 84 are directed so that their horizontal axis extended passes above all portions of the cam tracks 65 means that the resilient strap members 82 will at all times be exerting an upward force on the support strut 63.

In the configuration of FIG. 3, however, the "arm" length over which the strap members 82 exert the upward force is so long that the upward force is not sufficient to raise the support strut and associated structure upwardly against its own gravitational weight. Thus, when the air cylinder 78 first begins to pull the support strut 63 forwardly (to the right in FIG. 3), the follower wheels 75 track along the lower legs 67 of the cam tracks 65.

When the support strut and its associated structure reach the forward end of the bottom leg 67 of the cam track, the fact that the resilient strap members 82 must curve upwardly to enter the sleeve members 84 parallel to the axis of the sleeve members requires the strap members to be bent much more strongly, i.e., to be bent through a considerably smaller radius than is the case in solid lines in FIG. 3. This means that the upward force exerted by the strap members 82 on the support strut 63 and its associated structure will be considerably increased, and in the embodiment being described this force is sufficient to overcome the downward gravitational force on this structure, with the result that the cam follower wheels 75 run upwardly along the upward legs 68 of the cam tracks 65. This brings the assembly to the condition shown in FIG. 4, where the support strut 63 has risen to its maximum point along the upward leg 68.

It will be noted in FIG. 3 that, as the support strut 63 and the pusher blade 62 move rightwardly, the pusher blade is located closely adjacent the rollers 44, so that any sausages 15 located on the rollers at that point will be pushed to the right, beyond the free forward edge 55 of the table surface 22 and into the forward end of the tray 60.

At the end of this forward motion, as described above, the support strut 63 and the pusher blade 62 are raised upwardly so as to be clear of any further sausages 15 being displaced from the first endless conveyor 14 and onto the table surface 22.

When the cylinder 78 extends, the support strut 63 and the pusher blade 62 move rearwardly along a path which keeps them clear of the sausages 15, until the rearward end of the return leg 70 is reached. At this point, the resilient strap members 82 have become much weaker in terms of the upward force which they exert, with the result that gravitational force causes the support strut 63 and the pusher blade to descend along the downward leg 72, ending up in the position shown in FIG. 3. From this point, a further cycle is set to begin whenever called for by an appropriate timing mechanism or circuit.

Turning now to the sequence of events illustrated in FIGS. 3 and 4, FIG. 3 shows the first phase of the filling of a tray 60 with sausages. The filling pattern is one in which a first group of sausages are placed in the forward end of the tray, following which a second group is placed in the rearward end. The sausages remain at all times aligned in the forward direction, and the number of sausages side-by-side may typically be from four to eight or even more, depending upon the side of the tray.

Figure 2:
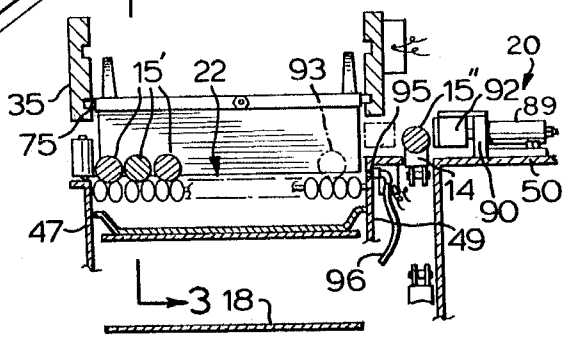
FIG. 2 is a vertical sectional view taken at the line 2—2 in FIG. 1.

In FIG. 3, it is assumed that the sausage shown at 15 is only one of a plurality of aligned sausages, the others of which cannot be seen because of the alignment. These sausages have been carried along the first conveyor 14 sequentially, and one by one they have been displaced off the first conveyor 14 by the loader means 20 (subsequently to be described in greater detail). The displacement causes the sausages to enter the table surface 22 at the side away from the viewer in FIG. 3, and air jets subsequently to be described gently roll the sausages toward the nearer side in FIG. 3 (the leftward or far side in FIG. 1), until they abut either the end rollers 54 or the immediately preceding sausage. FIG. 2 shows the situation with three sausages 15' already in place, and a fourth sausage 15'' about to be displaced from the conveyor 14.

When the required number of sausages have been placed on the table surface 22 in this manner, established by a counter mechanism which is well known in the art and by a counter mechanism which is well known in the art and does not form the focus of this invention, a signal is given to initiate one complete cycle for the air cylinder 78. The air cylinder 78 is normally "at rest" in its extended position as shown in FIG. 3. Upon a signal to initiate a cycle, the air cylinder contracts and again extends itself. By the action of the resilient strap members 82 described previously, this causes the pusher blade 62 to move forwardly and sweep all of the sausages into the forward end of the tray 60, then to rise up along the upward leg 68 of the cam track and return along the return leg clear of any additional sausages which may have come onto the table surface 22 in the meantime and finally down the leg 72 to return to the position of FIG. 3 immediately upstream or rearwardly of the newly arrived sausages.

When this first cycle has been completed, a signal is given to raise the stop bar **24*a* (FIG. 3) and to lower the downstream stop bar 24*b* into the position shown in dotted lines in FIG. 3 and in solid lines in FIG. 4**.

This will allow the tray 60 to move from the position shown in FIG. 3 to the dotted line position shown in FIG. 4 and identified by the numeral 60'. The solid line tray illustration in FIG. 4 is the same one as that of FIG. 3, but shows the sausages 15 in place in the forward end of the tray.

Thus, after the front end of the tray has been filled, the stop bars **24*a* and 25*b* reverse as just described, which allows the endless conveyor 18 (which is always moving) to carry the tray 60 forwardly to the downstream stop bar 24*b* as shown in broken lines in FIG. 4. This then presents the rearward end of the tray immediately forwardly adjacent the table surface 22 defined by the rollers 44. Throughout this procedure, additional sausages 15 are being accumulated on the table surface, and when the requisite number is achieved, a further signal is given to the air cylinder 78 to initiate another complete cycle, which sweeps the second lot of sausages into the rearward end of the tray. The tray is then completely filled with sausages, and the stop bar 24*b* is raised at another signal to allow the filled tray to pass forwardly beyond the apparatus being described. The tray may then pass on to other stations in which it is wrapped, stamped, or labelled, and so forth. As soon as the filled tray has passed beyond the stop bar 24*a*, the latter descends once again to the position shown in solid lines in FIG. 3, thereby to arrest forward motion of the next sequential tray at a position identical to that shown in FIG. 3 for the tray 60. The filling procedure then repeats, with two cycles of the air cylinder 78** causing two further lots of sausages to be deposited into the next sequential tray, one lot in the front and one lot in the back. The apparatus continues in this fashion so long as sausages and trays are supplied to it.

Detector means, which may be optical, electrical, or air-operated, are provided to tell the assembly when the filled tray has passed beyond the upstream stop bar 24*a*, so that the latter may descend. These means are not illustrated.

Figure 5:
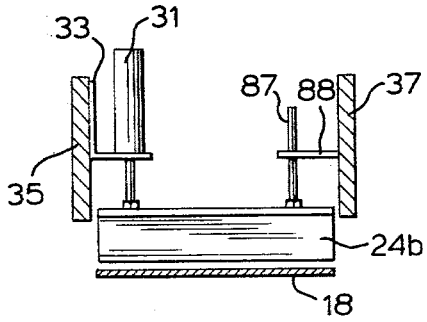
FIG. 5 is a vertical sectional view taken at the line 5—5 in FIG. 4.

In FIG. 5, the section at 5—5 in FIG. 4 is shown. It can be seen that the stop bar 24*b* is connected not only to the piston of the cylinder 31 but also to a guide rod 87 which extends slidingly through a bore in a further bracket 88 affixed to the side 37.

Attention is now directed to FIG. 2, which shows the loader means 20 in elevation. The loader means 20 includes an air cylinder 89 mounted on a bracket 90, and having its piston affixed centrally to a displacement block 92 at about the same horizontal level as the sausages 15 which are conveyed along the first conveyor 14. Upon the appropriate signal, the cylinder 89 extends its piston and the displacement block 92, thus knocking an adjacently located sausage to the left in FIG. 2 so that it falls down a slight incline and onto the table surface 22 defined by the rollers 44. The position of a sausage immediately upon contact with the table surface 22 is shown in broken lines and identified by the numeral 93. While it is possible to shove each sausage with sufficient force to cause it to roll all the way to the leftward end of the table surface 22 as pictured in FIG. 2, it is possible that, because of the softness of the sausages, such an impact is undesirable. If the impact were to distort the sausage cross sectional shape significantly, it might be difficult or even impossible for the sausage to roll correctly across the table surface 22. For this reason, there is provided a plurality of blow holes 95 in the partition 49, which are fed by an air line 96 from an appropriate source and through appropriate valve means. The blow holes are best seen in FIGS. 3 and 4, in terms of their orientation with respect to the table surface. Referring to FIG. 2, the blow holes 95 continually create a curtain of leftward moving air sweeping horizontally across the top of the table surface 22, such that the sausages sequentially fall onto the table at the rightward side as seen in FIG. 2, the air will gently but positively cause them to roll leftwardly over to the furthest leftward position which they can occupy.

Returning to FIG. 1, a length selection mechanism will now be described. This mechanism is shown generally at the numeral 170 in FIG. 1, and includes three photoelectric light generators 173, 174, and 175, together with matching light receptors 176 on the opposite side of the first endless conveyor 14.

The projectors 173, 174, and 175 are longitudinally adjustable with respect to the forward direction arrow 16, as are the receptors 176, and the operation is as follows. The optimum length of sausage 15 for use with the particular plates being employed is determined on the basis of the longitudinal dimension of a tray. The distance between projector 173 and 174 is slightly less than this optimum length, while the distance between projector 173 and 175 is slightly more than this optimum length. As the sausages pass along between the projectors 173,175, and their corresponding receptors, the light beams from the various projectors will be intercepted. A sausage will first cut the beams from projectors 175 and 174, and these two beams will be off together for a certain period. When the sausage has continued to the point where the beam from projector 173 is cut, the logic determines the condition of the light beams from projectors 174 and 175. If both of these are still cut, then the sausage is too long and it is rejected. If both of these are open, then the sausage is too short and again it is rejected. If the beam from projector 174 is cut but that from projector 175 is not, then the sausage is within the acceptable range and it is placed on the table 22 for insertion into the tray. Rejection takes place simply by not displacing the sausage from the conveyor 14 when it reaches the loading means 20. The sausage is then carried on further and simply runs free onto the mounting plate 50. The operator or one of the personnel attached to the assembly can then place the sausages which are rejected into a container to be reprocessed.

I claim:

1. Apparatus for repeatedly unloading limp, flaccid, easily deformable, uncooked sausages from a support table, comprising:

a support table having a low friction upper surface to permit movement of said sausages without blemishing said sausages;

a pusher member;

means for urging said pusher member alternately (a) in a forward direction across said support table from a retracted position to an unloading position and (b) in a rearward direction from said unloading position to said retracted position; and means for raising and lowering said pusher member, comprising:

a cam track mounted adjacent said pusher member and said support table, said track including a lower leg substantially parallel to said support table, an upward leg at the forward end of said lower leg, a return leg above said lower leg, and a downward leg joining the return and lower legs at the rear;

follower means on said pusher member for following said cam track;

a spring biasing said pusher member upward; and means for supporting said spring and for altering the biasing of said spring on said pusher member, said means providing a greater biasing force of said spring when said pusher member is at said unloading position and when said follower means is at said forward leg of said cam track than when said pusher member is at said retracted position and when said follower means is at said return leg of said cam track.

2. Apparatus, as defined in claim 1, wherein:

said spring comprises a flat spring member fixed to said pusher member; and said means for supporting said spring slidably supports the free end of said spring in an orientation which increases the biasing force of said spring on said pusher member as said pusher member moves from said retracted position to said unloading position.

3. Apparatus, as defined in claim 1, additionally comprising:

means for directing a curtain of air parallel to the surface of said support table to urge said sausages onto said support table.

4. Apparatus, as defined in claim 1, additionally comprising:

means for directing air under pressure against said sausages to assist in moving said sausages along said tray without blemishing said sausages.

* * * * *